United States Patent [19]

Menter et al.

[11] Patent Number: 4,611,986

[45] Date of Patent: Sep. 16, 1986

[54] DISPOSABLE LIQUID FUEL BURNER

[75] Inventors: J. Alan Menter, Fayetteville; Gerald A. Menter, Jamesville, both of N.Y.

[73] Assignee: Hollowick Inc., Manlius, N.Y.

[21] Appl. No.: 737,544

[22] Filed: May 24, 1985

[51] Int. Cl.[4] ..... F23D 3/24

[52] U.S. Cl. ..... 431/320; 431/298; 431/325

[58] Field of Search ..... 431/120, 125, 298, 320, 431/325, 301

[56] References Cited

U.S. PATENT DOCUMENTS

| | | | |
|---|---|---|---|
| 2,758,460 | 8/1956 | Ciano | 431/298 |
| 2,784,581 | 3/1957 | Quandt | 431/301 |
| 3,158,015 | 11/1964 | Renwick et al. | 431/125 |
| 3,162,030 | 12/1964 | Irving | 431/325 |
| 3,315,497 | 4/1967 | MacDonald | 431/320 |
| 4,126,408 | 11/1978 | Cox | 431/325 X |
| 4,526,530 | 7/1985 | Menter et al. | 431/325 X |
| 4,529,376 | 7/1985 | Cafolla | 431/320 |

*Primary Examiner*—Margaret A. Focarino
*Attorney, Agent, or Firm*—Bruns and Wall

[57] ABSTRACT

A die cut wick for use in a burner having a rectangular body that contains two half sections that are folded back into a face to face alignment. Each half section further contains a tab upwardly disposed from the top surface of the body, the tabs being centrally positioned on the half sections with the top surface of the body extending laterally to either side to form a shoulder. The tabs of the wick are folded against each other and passed upwardly through a hollow stud secured to the lid of the fuel container. The shoulders of the tabs abut the bottom surface of the lid to prevent the tabs from being drawn entirely through the stud and the body is secured to the bottom of the lid using holt melt glue or the like. The end of the tabs extend beyond the top of the stud to form the flame region of the burner. The end of the tabs extend beyond the top of the stud to form the flame region of the burner. The burning rate and heat output of the flame is controlled by separating the exposed ends of the tabs.

11 Claims, 4 Drawing Figures

DISPOSABLE LIQUID FUEL BURNER

BACKGROUND OF THE INVENTION

This invention relates generally to a disposable liquid fuel burner and, in particular, to a die cut wick suitable for use in this type of burner.

Recently, disposable liquid fuel burners have been introduced into the market for use in association with lamps for providing intimate table lighting or for warming foods in chafing dishes and the like. Typically, the burner includes a sealed container in which the fuel is stored and a wick that passes upwardly through the lid of the container which is lighted. When the fuel is exhausted, the container is simply discarded and replaced with a new unit.

Most disposable burners are preset in the factory to provide for an optimum flame height by exposing a limited length of wick above the top of the burner. Because the unit is intended to be thrown away when the fuel supply is exhausted, the wick assembly is relatively simple and inexpensive to construct. Accordingly, there is no means provided for selectively adjusting the flame height. Accordingly, the usefulness of the burner is limited. Oftentimes, in an effort to obtain higher heat or increased illumination the user will tamper with the wick. The wick will sometimes be extended by pulling it manually out from its holder. Invariably, the adjustment is unsuccessful and too much wick is exposed. Once this happens, the wick can no longer be shortened and the burner is rendered unusable for its intended purpose and is usually discarded.

SUMMARY OF THE INVENTION

It is therefore an object of the present invention to improve liquid fuel burners.

It is a further object of the present invention to improve disposable liquid fuel burners.

A further object of the present invention is to provide a simple and inexpensive liquid fuel burner having a wick that can be mounted in the factory to prevent the wick from being tampered with.

A still further object of the present invention is to provide a disposable burner having a wick whose burning rate and heat output can be adjusted without changing the exposed length of the wick.

These and other objects of the present invention are attained by means of a disposable burner that includes a single piece die cut wick having a rectangular body that is divided along its longitudinal axis into two similar half sections. Each half section has a raised tab centrally positioned thereon, the width of the tab being less than the width of the half section to provide a laterally extended shoulder at the base of each tab. In assembly, the wick is folded in half to place the tabs in a face to face relationship. The tabs are then extended through a vertically disposed hollow stud mounted in the lid of the container to bring the shoulders into abutting contact with the bottom surface of the lid. The body of the wick is secured to the bottom of the lid using a hot melt glue or the like. The lid is then sealed to the container by seaming the periphery of the lid to the top of the container. The burning rate and heat output of the flame, in this assembly, can be adjusted by separating the exposed ends of the tabs.

BRIEF DESCRIPTION OF THE DRAWINGS

For a better understanding of these and other objects of the present invention, reference is had to the following detailed description of the invention which is to be read in association with the accompanying drawings, wherein.

DESCRIPTION OF THE INVENTION

Figure 1:
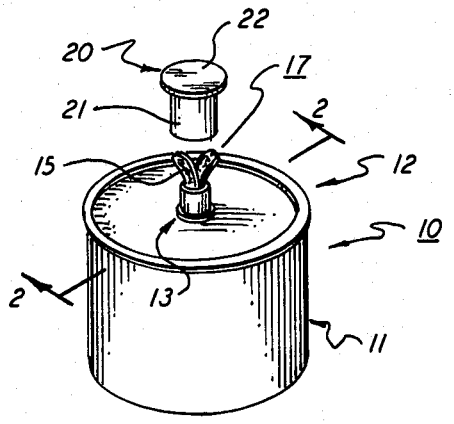
FIG. 1 is a perspective view of a disposable burner embodying the teachings of the present invention.

Turning initially to FIG. 1 there is shown a disposable burner unit generally referenced 10, which embodies the teachings of the present invention. The burner includes a cylindrical container 11 that is adapted to hold a quantity of liquid fuel therein. The top of the container is closed by means of a lid 12 having a hollow stud 13 vertically disposed from the center thereof. The stud has an opening formed therein which opens into the container. As will be explained in greater detail below, the stud is arranged to house a pair of tabs 15—15 that form the upper part of a wick 17.

A cap 20, preferably made of plastic, is also furnished with the unit to enclose the exposed end of the wick when the burner is stored or packaged for shipping. The cap has a hollow cylindrical shank 21 that is capable of being passed over the exposed tips of the wick and slidably received upon the stud. A slight interference fit is provided between the interior surface of the shank and the exterior surface of the stud so that a fluid tight seal is formed therebetween when the cap is positioned on the unit. The cap further includes an expanded end flange 22 that closes the distal end of the cap and furnishes a gripping surface that facilitates removal of the cap. The length of the shank is sufficiently long so that it can accommodate the wick without crushing or otherwise harming the tabs.

Figure 3:
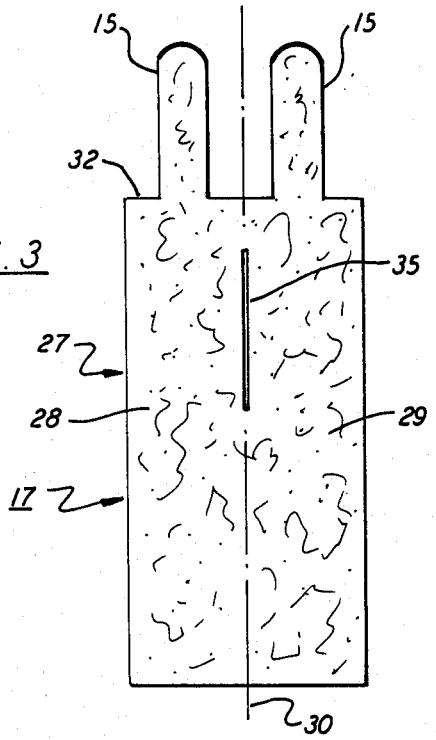
FIG. 3 is a front elevation of a die cut wick used in the burner shown in FIG. 1.

As best illustrated in FIG. 3, the wick 17 is die cut from a sheet of any suitable wicking material using well known die cutting techniques. The material used is preferably a felt like fabric which is capable of drawing the liquid fuel 25 (FIG. 2) from the container and bringing it via capillary action to the tabs 15—15 extended above the stud. The wick properties should be such that the tabs will not be consumed when lighted so long as the wick is able to provide fuel to the tabs from the container. This type of wick is sometimes referred to as a nonconsumable wick.

The body 27 of the wick is generally rectangular in form and includes two half sections 28 and 29 that are located to either side of the longitudinal axis 30 of the body. The tabs 15—15 of the wick are upwardly disposed from the flat top surface 32 of the body. Each tab is centrally positioned on its associated half section with the width of the tab being about one half the width of the half section. Accordingly, the top surface of the body forms a shoulder which extends laterally to either side of the tab at its base. An elongated cut or slit 35 is passed through the body of the wick and runs along axis 30 at the top section of the body immediately below top surface 32. The length of the slit is at least one third the entire length of the wick body and, in practice, provides a guide about which the two half sections can be folded to place the tabs in face to face alignment as illustrated in FIG. 2.

Figure 2:
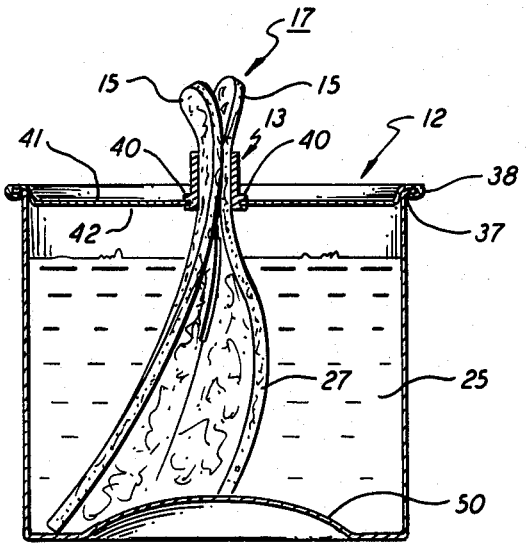
FIG. 2 is an enlarged view in section taken along lines 2—2 in FIG. 1 showing the interior of the burner.

With further reference to FIG. 2, lid 12, in assembly, is seamed over the top lip 37 of the container to provide a liquid tight seal 38 about the periphery of the lid. The stud 13, which is a hollow cylindrical member, contains a radially extended flange 40 that seats against the top surface 41 of the lid. The base of the flange passes downwardly through a hole formed in the lid and, in assembly, is expanded outwardly in a radial direction to crimp the stud against the lid at 43. Accordingly, the stud is supported in the lid in an upright vertical position as shown in FIG. 2.

Figure 4:
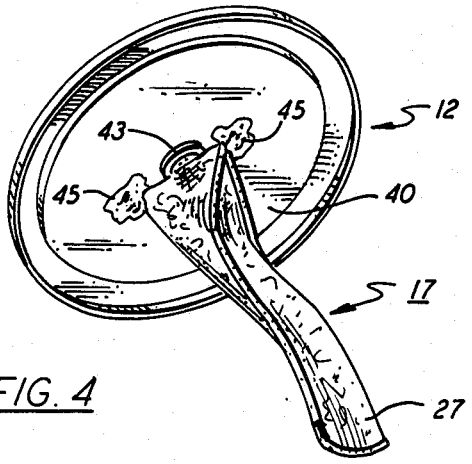
FIG. 4 is an enlarged perspective view showing the bottom surface of the lid used to close the burner with the wick being secured thereto.

In assembly, the wick is folded back upon itself to place the tabs in abutting alignment. The tabs are then passed upwardly through the base of the stud to extend the tips of the tabs above the top of the stud. The tabs are drawn upwardly through the stud until the shoulders formed by the top surface 32 of the wick body abut the bottom surface 42 of the lid. The length of the tabs are cut to be longer than the axial length of the stud so that a precise and predetermined length of each tab protrudes above the top of the stud. The exposed ends of the tabs will be lighted in use and thus form the burning region of the wick. Once the wick is positioned in the stud, the body of the wick is permitted to fan out beneath the bottom surface 40 of the lid. Using an application gun, hot melt glue 45 is applied to the wick at a number of points to adhere the wick to the bottom surface of the lid as shown in FIG. 4.

After the wick is secured in place, the lid is placed over the container and, as explained above, the seam is rolled closed using a well known seaming technique. The fanned out body of the wick is permitted to hang down into the fuel as seen in FIG. 2. The length of the wick body is sufficiently long so that it will drape over the bottom wall 50 of the container thereby enabling the wick to draw most, if not all, the fuel stored in the container up into the burning region. Finally, to close the burner prior to packaging, the cap 20 is press fitted to the stud thus rendering the entire unit leak proof.

While this invention has been described with specific reference to the detailed description set forth above, it is not confined to this specific structure and this application is intended to cover any modifications and changes that may come within the scope of the following claims.

We claim:

1. A die cut wick that is formed from a single sheet of wicking material for use in a disposable burner that includes a body having a planar top surface, said body containing a slit extending along a portion of its longitudinal axis to divide the body into two half sections, each half section further including a tab upwardly disposed from said top surface, each tab being centrally positioned upon the half section and having a width that is less than the width of the half section so that the top surface of the body forms a laterally extended shoulder at the base of each tab whereby the wick can be folded back upon itself along the line described by the slit to place the tabs in face to face alignment.

2. The wick of claim 1 whereby the width of the said tabs is about half the width of each half section.

3. The wick of claim 1 whereby the slit formed in the body is completely surrounded with wick material and is at least one third the entire length of the body.

4. The wick assembly of claim 3 wherein the slit is located at the upper part of the body immediately below the top surface thereof.

5. A burner unit that includes an open topped container for holding a quantity of liquid fuel, a single piece wick having a body that is divided along a longitudinal axis into two half sections, each half section further including a raised tab that is positioned upon the top surface thereof, each tab having a width that is less than the width of the half section and being folded over into face to face alignment whereby a shoulder extends to either side of the tabs at their base, a lid for closing the top of the container, a raised stud vertically mounted in the lid having a length that is less than the extended length of said tabs, said stud having an opening that passes into the container for slidably receiving the tabs therein with the tab shoulders in abutting contact against the bottom surface of the lid and the ends of the tabs extending above the top of the stud, and means to secure the body of the wick to the bottom of the lid.

6. The burner assembly of claim 5 wherein the length of the stud is less than that of the tabs so that a predetermined length of the tabs is exposed.

7. The burner assembly of claim 5 wherein the body of the wick contains a slit along a portion of its longitudinal axis whereby the half sections can be folded back along the line of the slit.

8. The burner assembly of claim 5 that further includes seam means for sealing the lid to the container.

9. The burner assembly of claim 5 that further includes an elongated cap that is capable of being press fitted upon the stud to close the stud opening.

10. The burner of claim 5 wherein the means for securing the body of the wick to the lid is a hot melt glue.

11. A die cut wick that is formed from a single sheet of wicking material suitable for use in a fuel burner, said wick including a body having a plannar top surface that can be folded back upon itself along a lateral centerline that is perpendicular to said plannar surface to form two half sections, each half section including at least one tab that is upwardly disposed from said plannar surface and having a width that is less than the width of the half section so that the top surface of the body forms a shoulder that extends laterally from the base of each tab.

* * * * *